US005651575A

United States Patent [19]

Bystrom et al.

[11] Patent Number: 5,651,575

[45] Date of Patent: Jul. 29, 1997

[54] BAG CARRIER HANDLE

[76] Inventors: Andrew P. Bystrom, 421 S. La Fayette Park Pl., Apt. 524, Los Angeles, Calif. 90057; Benjamin L. Bystrom, 5446 Kirkwood Pl., Honolulu, Hi. 96821

[21] Appl. No.: 463,577

[22] Filed: Jun. 5, 1995

[51] Int. Cl.[6] ..... A45C 13/22; B65D 33/06

[52] U.S. Cl. ..... 294/171; 294/137

[58] Field of Search ..... 294/137, 165, 294/166, 170, 171; 383/6, 13, 25, 29; 16/114 R, 114 B; D9/434

[56] References Cited

U.S. PATENT DOCUMENTS

| | | | |
|---|---|---|---|
| D. 328,187 | 7/1992 | Saurettee | 294/171 |
| 824,904 | 7/1906 | Cammett et al. . | |
| 1,401,854 | 12/1921 | Almedia . | |
| 2,274,605 | 2/1942 | Hoffmeister . | |
| 2,319,316 | 5/1943 | Gerendas . | |
| 2,448,894 | 9/1948 | Laus | 294/171 |
| 3,635,382 | 1/1972 | Wilson | 294/166 |
| 3,912,140 | 10/1975 | Franges . | |
| 3,913,172 | 10/1975 | Richards et al. . | |
| 4,004,722 | 1/1977 | Olivier . | |
| 4,040,562 | 8/1977 | Ward et al. . | |
| 4,071,063 | 1/1978 | Russell | 294/171 |
| 4,112,541 | 9/1978 | Tetradis . | |
| 4,590,640 | 5/1986 | Enersen . | |
| 4,637,097 | 1/1987 | Secord . | |
| 4,796,936 | 1/1989 | Sherin . | |
| 4,890,355 | 1/1990 | Schulten . | |
| 5,029,926 | 7/1991 | Dieterich, Jr. | 294/171 |
| 5,083,825 | 1/1992 | Bystrom et al. . | |
| 5,088,667 | 2/1992 | Olson | 294/171 |

*Primary Examiner*—Dean Kramer
*Attorney, Agent, or Firm*—John J. Posta, Jr.

[57] ABSTRACT

The improved handle is useable to facilitate carrying a bag having one or more flexible top straps. The handle includes a shell of relatively inflexible durable material, such as wood, metal or plastic. The shell is generally elongated and tubular with a central hollow bag strap-receiving space. The shell has open opposite ends and is divided into two mating shell parts extending the length of the shell. The two shell parts bear integral connector components adjacent their upper ends in the form of a hook and notch and the shell parts are hinged together adjacent their lower ends by an internal flexible resilient hinge of elastomeric material. The lower ends of the two parts have upturned terminal flanges over which the hinge is permanently secured. The hinge has a raised or domed central portion and downwardly sloping sides and forms with the lower internal surfaces of the two shell parts a pair of spaced longitudinally extending lateral bag strap-receiving pockets which keep the weight of a bag being carried off the main portion of the hinge. A detent in the upper end of the shell prevents over flexing of the hinge when releasably connecting the two shell parts and reduces unwanted opening. The two shell parts may have external ribs or a roughened external surface to facilitate hand gripping, and an optional upper releasable terminal flap to seal the shell parts in place.

9 Claims, 1 Drawing Sheet

BAG CARRIER HANDLE

BACKGROUND OF THE INVENTION

1. Field of the Invention

The present invention generally relates to carrier means and more particularly to an improved handle for carrying bags having flexible carrying straps.

2. Prior Art

Various types of handles have been proposed in the past to assist in carrying portable container bags and the like. See, for example, the various handles shown and described in the following U.S. Pat. Nos. 824,904; 3,913,172; 4,40,562; 2,319,316; 3,912,140; 4,004,722; 4,112,541; 1,401,854; 4,590,640 and 5,083,825. Such devices range from handles attached to strings and hooks designed to releasably connect to bag straps to exotic grips sometimes found for securing mailbags and the like. Many of such handles are adapted for permanent installation on the straps of the containers and bags and may be unsightly, cumbersome and complicated.

There remains a need for a simple, durable, efficient, inexpensive, reusable bag carrier handle which is relatively light in weight and which is easy to install on one or more carrier bag straps and just as easy to remove therefrom but which provides a non-slip comfortable grip.

SUMMARY OF THE INVENTION

The improved bag carrier handle of the present invention satisfies all the foregoing needs. The handle is substantially as set forth in the ABSTRACT OF THE DISCLOSURE.

Thus, the bag carrier handle is generally elongated and cylindrical, lending it to easy gripping by the hand, with even distribution of the weight of the bag for easier carrying. The handle is very simple and inexpensive to make and easy to install on one or more bag straps and just as easy to remove therefrom. The handle is also decorative in appearance, durable and adaptable to straps of various thicknesses. The handle is strong so that very heavy bag weights can be carried with the handle without any danger of breaking the handle.

The handle comprises a generally tubular elongated shell, preferably about cylindrical and defining a central bag strap-receiving space which extends from one end of the handle to the opposite end thereof. The shell is fabricated of relatively inflexible, hard durable material, such as wood, metal, hardened rubber, plastic, ceramic or cermet, although other materials and combinations thereof can be used. The shell is divided into two mating shell parts by a spaced pair of slits.

The bottom of the shell parts are permanently connected by a a flexible resilient elastomeric hinge of rubber, plastic or the like for movement between a closed shell position and an open shell position. Preferably, the lower ends of the shell parts terminate in upturned flanges. Preferably, the hinge comprises a central raised or domed portion integrally connected to sloping sides which are permanently connected, as by heat bonding, gluing or the like, to the shell part flanges which are spaced apart and parallel to each other. Also preferably, the flanges and hinge extend the full length of the shell. With this arrangement, the hinge sides and adjacent internal surfaces of the shell parts form spaced parallel side pockets or grooves in which the bag straps fit, so that the full weight of the bag is not on the central portion of the hinge but distributed to the sides thereof, so that hinge stress is substantially reduced.

The upper ends of the two shell parts are releasably connected together by integral connector means, preferably in the form of a hook on one shell part and a mating recess or notch in the other of the two shell parts. In order to prevent overflexing in connecting the two shell parts together adjacent the upper ends thereof through the hook and notch, which preferably extend the entire length of the handle, an integral detent is provided adjacent the point of connection, which detent prevents the two shell parts from overlapping any further than needed to make the desired connection. Also, the integral detent reduces unwanted openings of the two shells.

The two shell parts thus operate in clamshell fashion to open in order to receive the strap or straps in the central space of the shell and then to releasably close in order to hold the strap or straps securely within the shell. An additional securing means may also be provided in the form of a terminal flap on the upper edge of the shell part which overlaps the other shell part. This flap not only releasably seals the shell parts together, but assures a smooth contour to the upper part of the shell.

Firm hand gripping of the handle is facilitated, preferably through the use of a plurality of spaced longitudinally extending external ridges on the shell outer surfaces. Alternatively or additionally, the shell outer surfaces can be roughened, particularly the lower portions thereof.

An improved Bag Carrier Handle can be easily made by the plastic co-extrusion process, using a two material die. This process provides a complete handle. Thus, the handle and its tooling are inexpensive and easy to make.

Further features of the improved handle of the present invention are set forth in the following detailed description and accompanying drawings.

DRAWINGS

DETAILED DESCRIPTION

FIGS. 1–3.

Figure 1:
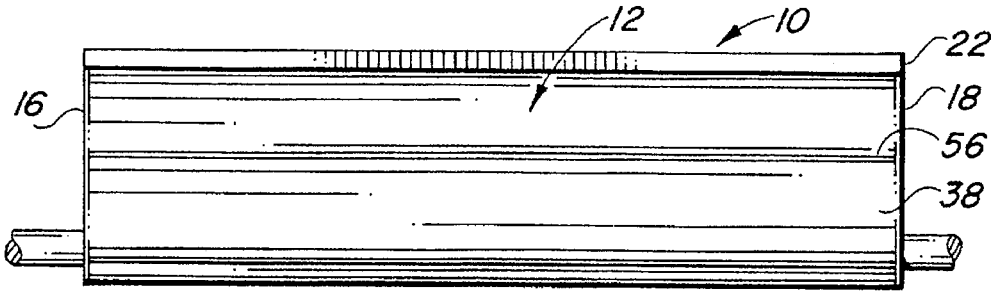
FIG. 1 is a schematic side elevation of a first preferred embodiment of the improved bag carrier handle of the present invention, shown with the straps of a bag carrier disposed therein so that the handle is ready for use in carrying the bag.
Figure 2:
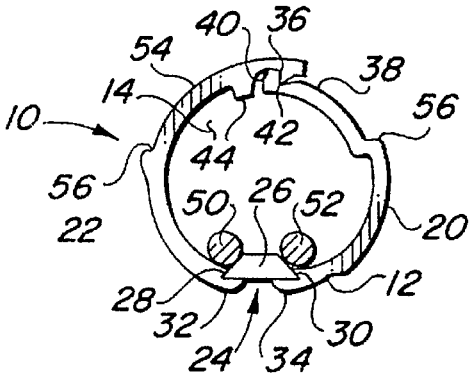
FIG. 2 is a schematic end view of the handle of FIG. 1 in the closed position and with a pair of spaced bag carrying straps, shown in cross section, disposed therein.
Figure 3:
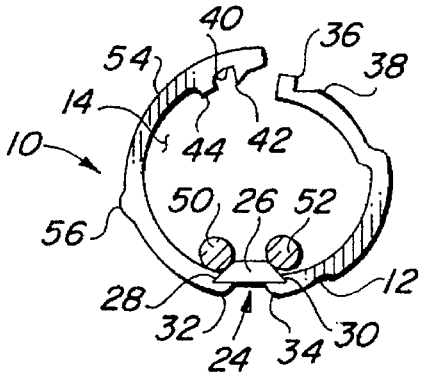
FIG. 3 is a schematic end view of the handle of FIG. 1 in the open position which permits the insertion of bag carrier straps, shown in cross section, therein and just as easy removal of the bag straps therefrom.

Now referring more particularly to FIGS. 1–3 of the drawings, a first preferred embodiment of the improved bag carrier handle of the present invention is schematically set forth therein.

Thus, handle 10 is shown, which comprises a shell 12 of stiff, relatively inflexible durable, load-carrying material such as metal, wood, ceramic, cermet and preferably plastic or hardened rubber. Shell 12 is generally tubular, that is, generally cylindrical, and defines a generally central space 14 extending from one open end 16 to the opposite open end 18 thereof.

Shell 12 is formed of two mating generally semi-circular (in end view) longitudinally extending shell parts 20 and 22 joined together at the bottom thereof by a longitudinally extending flexible resilient hinge 24 of an elastomeric material such as plastic or rubber. Hinge 24 is of a special shape. Thus, hinge 24 has a central raised or domed portion 26 (FIGS. 2 and 3) integrally connected to a pair of downwardly sloping tapered sides 28 and 30. Preferably, the lower ends of shell parts 20 and 22 terminate in upwardly extending parallel flanges 32 and 34 joined, as by heat bonding, adhesive or the like, to the undersides of hinge sides 28 and 30 so that flanges 32 and 34 are spaced apart. If desired, portion 26 can extend down into the gap between flanges 32 and 34 and be sealed thereto.

Hinge 24 enables shell 12 to be urged between the closed bag carrier strap-retaining position of FIG. 2 and the open bag carrier strap entry and removal position of FIG. 3. Thus, hinge 24 enables shell 12 to function in a clamshell-like manner.

Shell part 20 bears a hook 36 in the outer surface 38 thereof (FIGS. 2 and 3) while shell part 22 bears a notch 40 formed in the inner surface thereof by a short sloped detent 42 depending therefrom and a second longer detent 44 depending therefrom and spaced inwardly from detent 42. Detent 42 releasably engages hook 36, while detent 44 serves as a block against over-flexing or over-stressing hinge 24 when releasably interconnecting shell parts 20 and 22. Also, detent 44 inhibits hook 36 from unwanted opening of the two shells. Thus, shell parts 20 and 22 can be easily releasably locked together into the position of FIG. 2 for using handle 10 for carrying purposes and can be opened to insert or remove one or a pair of bag carrier straps before or after such carrying (FIG. 3).

An important feature of handle 10 is the configuration of hinge portion 26, which is domed, sloping hinge sides 28 and 30 and adjacent portions of shell parts 20 and 22. This configuration provides parallel longitudinally extending pockets 46 and 48 in which bag carrier straps 50 and 52 releasably reside in space 14. Thus, the weight of a bag connected to straps 50 and 52 is borne by the lower ends of shell parts 20 and 22 rather than directly on hinge 24, thus avoiding unduly stressing hinge 24 and causing breakage of handle 10. This increases the life of handle 10 and enables it to be efficiently used for carrying weights much greater than could be done if the full weight being carried were directly on the flexible resilient hinge 24.

In order to promote a firm grip on handle 10 for carrying purposes, preferably the outer surfaces of shell 12, that is, outer surface 38 of shell part 20 and outer surface 54 of shell part 22 are provided with special gripping means in the form of integral, parallel, spaced, longitudinally extending ridges 56 extending outwardly therefrom. Also, a portion of outer surface 54 is free of ridges 56 for the easy addition of advertising on its surface.

Shell parts 20 and 22 are easily and inexpensively heat bonded with hinge 24 through the co-extruded process.

Figure 4:
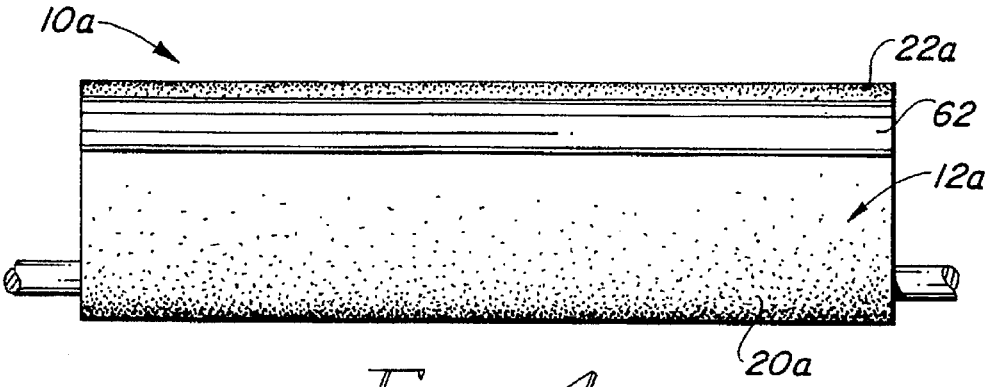
FIG. 4 is a schematic side elevation of a second preferred embodiment of the improved bag carrier handle of the present invention; and, FIG. 5 is a schematic end view of the handle of FIG. 4 in the closed position around a pair of spaced bag carrier straps, shown in cross section.
Figure 5:
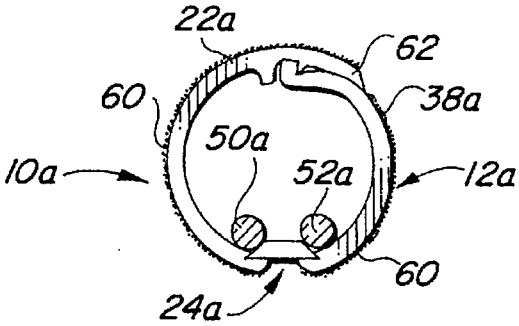

FIGS. 4 and 5.

A second preferred embodiment of the improved handle of the present invention is schematically shown in FIGS. 4 and 5. Thus, handle **10*a* is shown. Components thereof similar to those of handle 10** bear the same numerals but are succeeded by the letter "a".

Handle **10*a* is substantially identical to handle 10**, except as follows:

a) Instead of ridges 56, outer surfaces **38*a* and 54*a* of, respectively, shell parts 20*a* and 22*a* are roughened, as by minute indentations and protrusions 60** therein, which may be achieved, for example, by sand blasting or the like.

b) In addition, the upper end of shell part **22*a* is provided with a tapered flap 62 which releasably seals part 22*a* to part 20, flap 62 releasably sticking to surface 38*a*. Flap 62 also smooths the contour of the upper portion of handle 10*a*, as shown in FIG. 5**.

Handle **10*a* has the remaining features and advantages as previously pointed out for handle 10**.

Various modifications, changes, alterations and additions can be made in the improved handle of the present invention, its components and parameters. All such changes, modifications, alterations and additions as are within the scope of the appended claims form part of the present invention.

What is claimed is:

1. An improved bag carrier handle for a bag having at least one flexible strap, said handle comprising, in combination:

a) an outer, generally tubular, hollow, rigid, elongated shell having open opposite ends, said shell defining a central, bag strap-receiving space extending the length of said shell to said open opposite ends, said shell being divided into first and second mating parts extending the length of said shell and having inner and outer surfaces, said two shell parts including along the length of the upper ends thereof integral releasably interlocking means for opening and closing said shell; and, b) an inner flexible resilient hinge extending along the length of said shell and secured to the inner surfaces of said two shell parts adjacent the lower ends thereof, said hinge holding said two shell parts for movement between an open, bag strap-receiving position and a closed bag strap-retaining position, the lower ends of said two shell parts being reflected upwardly and spaced apart by said hinge, said hinge having a raised central portion, said hinge and two shell parts forming a pair of spaced, generally parallel, lateral bag strap-receiving spaces extending the length of said shell, said spaces being positioned at about the side margins of said hinge, whereby pressure on said central raised portion of said hinge is minimized.

2. The improved handle of claim 1 wherein said hinge is arcuate in end view, said raised central portion of said hinge being integrally connected to downwardly sloping tapered sides to provide with said upwardly reflected lower ends of said two shell parts said lateral bag strap-receiving spaces.

3. The improved handle of claim 1 wherein said integral releasable interlocking means comprise an integral hook on the outer surface at the upper end of the first of said shell parts and an integral hook-receiving notch on the inner surface at the upper end of the second of said shell parts.

4. The improved handle of claim 3 wherein said hook and said hook-receiving notch extend the length of said two shell parts.

5. The improved handle of claim 4 wherein said second shell part includes adjacent said upper end a downwardly depending integral detent extending along at least a portion of the length of the inner surface of said first shell part in a position which prevents over-flexing of said hinge when interconnecting said shell parts and reduces unwanted opening of the two shells.

6. The improved handle of claim 1 wherein said shell is inflexible plastic and said hinge is resilient elastomeric material.

7. The improved handle of claim 1 wherein the exterior of said shell is generally cylindrical and the exterior surface of said shell is roughened to provide non-slip gripping.

8. The improved handle of claim 1 wherein the exterior of said shell bears a plurality of spaced longitudinally extending outwardly projecting ridges which facilitate hand gripping of said handle.

9. The improved handle of claim 1 wherein the upper end of said first shell part includes a flexible terminal tab releasably adherent to the outer surface of said shell to facilitate said interlocking of said two shell parts.

* * * * *